US010470537B1

(12) United States Patent
Sarr

(10) Patent No.: US 10,470,537 B1
(45) Date of Patent: Nov. 12, 2019

(54) AMBULATORY CANE UMBRELLA

(71) Applicant: Thierry Sarr, Los Angeles, CA (US)

(72) Inventor: Thierry Sarr, Los Angeles, CA (US)

( * ) Notice: Subject to any disclaimer, the term of this patent is extended or adjusted under 35 U.S.C. 154(b) by 0 days.

(21) Appl. No.: 16/360,135

(22) Filed: Mar. 21, 2019

Related U.S. Application Data

(60) Provisional application No. 62/699,073, filed on Jul. 17, 2018.

(51) Int. Cl.
*A45B 23/00* (2006.01)
*A61G 5/02* (2006.01)

(52) U.S. Cl.
CPC ..... *A45B 23/00* (2013.01); *A61G 5/02* (2013.01); *A45B 2023/0006* (2013.01)

(58) Field of Classification Search
CPC .. A45B 23/00; A45B 2023/0006; B61G 5/02; B62B 2202/52
See application file for complete search history.

(56) References Cited

U.S. PATENT DOCUMENTS 376,870 A 1/1888 Ellis
1,340,375 A 5/1920 Arthur
2,582,435 A * 1/1952 Howard ..... B62B 1/002 280/47.18
2,806,711 A * 9/1957 Jacobs ..... B62B 1/262 211/70
3,866,934 A * 2/1975 Braun ..... A63B 55/60 280/655
4,962,781 A 10/1990 Kanbar
5,188,138 A 2/1993 Yamasaki et al.
5,310,155 A * 5/1994 Wu ..... F16M 13/022 224/274
5,636,852 A * 6/1997 Sistrunk ..... B62B 1/12 248/156
5,957,145 A * 9/1999 Plumer ..... E04H 12/2238 135/16
6,113,129 A * 9/2000 Marques ..... B62B 1/12 248/129
6,182,877 B1 2/2001 Rolfe
6,601,865 B1 * 8/2003 Harper ..... A61G 5/08 280/304.1
7,819,407 B1 * 10/2010 Charitun ..... B62B 1/12 280/47.18
8,327,963 B1 * 12/2012 Faulkingham ..... B62B 5/0076 180/167
10,266,192 B2 * 4/2019 Terry ..... B62B 1/26
(Continued)

*Primary Examiner* — Noah Chandler Hawk
(74) *Attorney, Agent, or Firm* — Global Intellectual Property Agency, LLC; Daniel Boudwin

(57) ABSTRACT

An ambulatory cane umbrella designed to allow a user to use a cane and umbrella in tandem. The ambulatory cane umbrella includes a base having an upper surface and a lower surface with a plurality of supports disposed around a perimeter of the base extending from the lower surface. One or more wheels are disposed on the lower surface. A support structure extends perpendicular to the base with a handle disposed atop the support structure. A basket is disposed along the support structure with an aperture in the handle in communication with an interior of the basket. A support brace is disposed at a distal end of the handle opposite the basket, wherein the support brace is designed to hold an umbrella therein. In this way, a user is able to use a cane and an umbrella in tandem with one another.

34 Claims, 3 Drawing Sheets

(56) References Cited

U.S. PATENT DOCUMENTS

| | | | | |
|---|---|---|---|---|
| 2018/0209166 | A1* | 7/2018 | Bullock | E04H 15/06 |
| 2019/0059531 | A1* | 2/2019 | Patin | A45B 3/04 |
| 2019/0069652 | A1* | 3/2019 | Rosedale | A45B 23/00 |

* cited by examiner

AMBULATORY CANE UMBRELLA

CROSS REFERENCE TO RELATED APPLICATIONS

This application claims the benefit of U.S. Provisional Application No. 62/699,073 filed on Jul. 17, 2018. The above identified patent application is herein incorporated by reference in its entirety to provide continuity of disclosure.

BACKGROUND OF THE INVENTION

The present invention relates to cane umbrellas. More specifically, the invention provides a base having a pair of wheels on a lower surface with a support structure extending upwardly and a handle disposed thereon, with a pivotable support brace configured to have an umbrella therein.

Many people use canes for stability when out walking and are typically to use only one hand when walking with the cane. Unfortunately, when there is inclement weather, these individuals often struggle to hold an umbrella while using their canes simultaneously. Additionally, these users struggle to carry or transport personal items during poor weather. Further, because of these difficulties, many individuals stop going outside during periods of poor weather. Thus, an improved ambulatory cane umbrella that can efficiently utilize a cane and an umbrella in tandem is desired.

SUMMARY OF THE INVENTION

In view of the foregoing disadvantages inherent in the known types of cane umbrellas now present in the known art, the present invention provides a cane umbrella wherein the same can be utilized for providing convenience for the user when desiring to utilize a cane and an umbrella in tandem.

The present system comprises an ambulatory cane umbrella. The ambulatory cane umbrella comprises a base having an upper surface and a lower surface with a plurality of supports disposed around a perimeter of the base extending from the lower surface. One or more wheels are disposed on the lower surface. A support structure extends perpendicular to the base with a handle disposed atop the support structure. A basket is disposed along the support structure with an aperture in the handle in communication with an interior of the basket. A support brace is disposed at a distal end of the handle opposite the basket, wherein the support brace is configured to hold an umbrella therein. In this way, a user is able to use a cane and an umbrella in tandem with one another.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
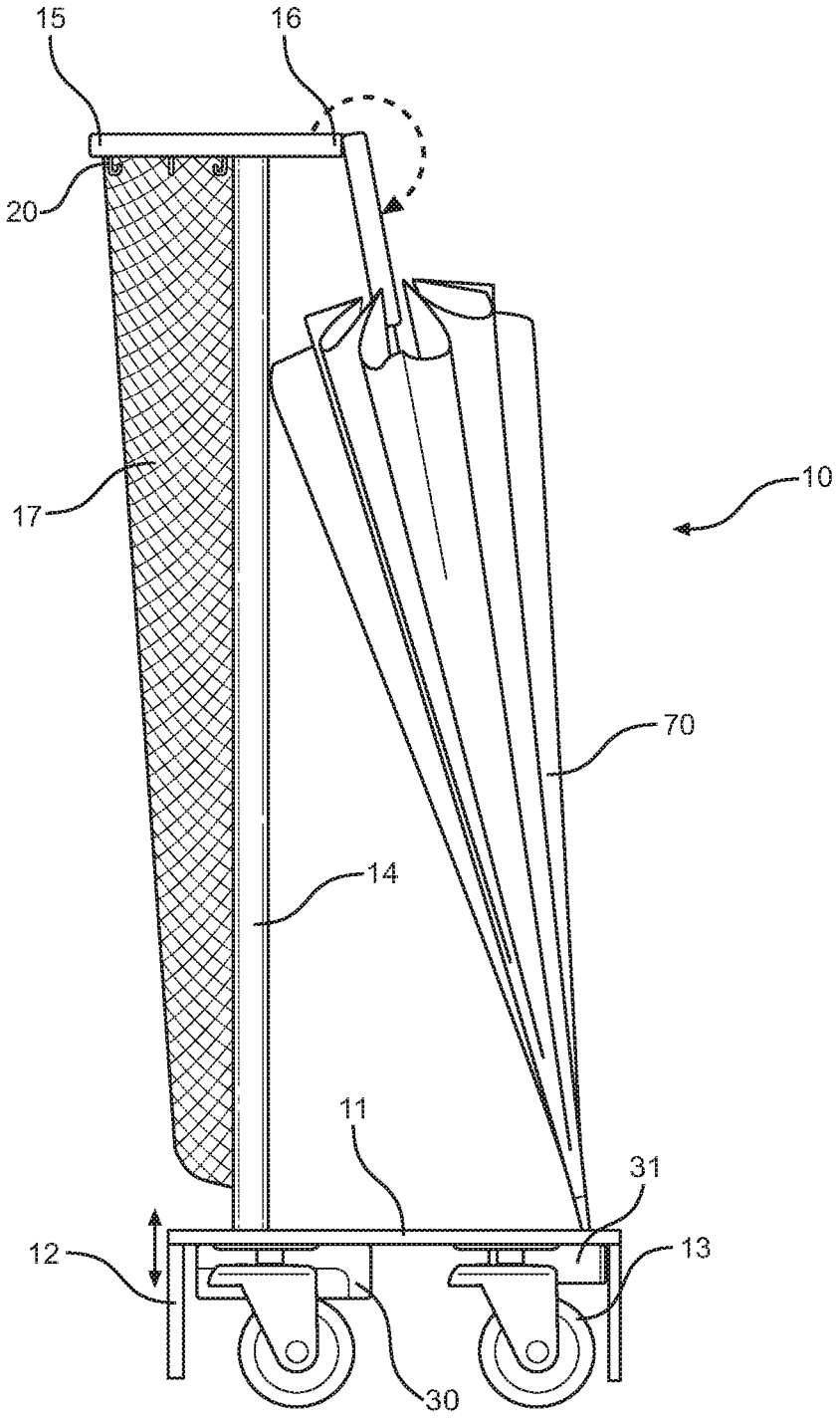
FIG. 1 shows a side view of an embodiment of the ambulatory cane umbrella.

Reference is made herein to the attached drawings. Like reference numerals are used throughout the drawings to depict like or similar elements of the ambulatory cane umbrella. The figures are intended for representative purposes only and should not be considered to be limiting in any respect.

Referring now to FIG. 1, there is shown a side view of an embodiment of the ambulatory cane umbrella. An ambulatory cane umbrella 10 comprises a base 11, having a pair of supports 12 around a perimeter of the base 11. In the shown embodiment, the pair of supports 12 are disposed on opposing ends of the base 11. In the illustrated embodiment, the base 11 is planar, such that objects can be placed and stored thereon without the user fearing the items will roll off and become lost. In some embodiments, a lip is disposed about the perimeter of the base 11 extending orthogonally from an upper surface of the base 11 to further prevent items placed thereon from falling therefrom. A pair of wheels 13 are disposed on a lower surface of the base 11, wherein the supports 12 are disposed around the wheels 13. In the shown embodiment, the wheels 13 are disposed on pivotable casters, such that the wheels 13 can rotate 360-degrees, thereby allowing the user to move ambulatory cane umbrella 11 in any direction. Further, in the illustrated embodiment the supports 12 are deployable, such that the user can choose whether to utilize the supports 12. In some embodiments, the supports 12 comprise a bar member slidably disposed through the base 11, wherein the supports 12 are configured to selectively move between a retracted position and a deployed position, wherein the retracted position the supports 12 rest above the base 11, and rest below the base 11 when in the deployed position, as in the shown embodiment. In one embodiment, when the supports 12 are deployed, such that the supports 12 are disposed perpendicular to the base 11, the supports 12 act as a braking system, preventing the base 11 from moving. In the illustrated embodiment, the base 11 further comprises a motor 30 disposed on a lower surface of the base 11, wherein the motor 30 is operably connected to a power source 31 and the wheels 13. In this way, the user can operate the wheels 13 via mechanical energy provided by the motor 30, thereby reducing strain to the user. In some embodiments, the power source 31 comprises a rechargeable battery.

A support structure 14 is disposed on the upper surface of the base 11 opposite the wheels 13. The support structure 14 is oriented perpendicular to the base 11, such that the support structure 14 extends outwardly from the base 11. The support structure 14 includes a distal end opposite the base 11, such that the support structure 14 includes a height as defined by the distance between the base 11 and the distal end of the support structure 14. In the illustrated embodiment, the support structure 14 is dimensioned such that the height of the support structure 14 is equivalent to waist height on an individual. As such, the exact dimensions for the support structure 14 vary appropriately. In some embodiments, the support structure 14 is telescopically adjustable, such that the height of the support structure 14 can be varied for multiple users. In the shown embodiment, the support structure 14 is disposed atop the base 11 proximate to a user side, such that the base 11 has a majority of surface area given over to storage. However, in other embodiments, the support structure 14 can be disposed anywhere along the base 11 and may be disposed at a center of the base 11, per the user's desired position.

A handle 15 is disposed at the distal end of the support structure 14. In the illustrated embodiment, the handle 15 is oriented perpendicular to the support structure 14, such that the handle 15 is parallel to the base 11. However, in other embodiments, the handle 15 extends outwardly from the support structure 14 at an angle, thereby providing the user with a greater degree of torque when pushing or pulling the ambulatory cane umbrella 10. In some embodiments, the handle 15 comprises planar top having a trapezoidal shape, such that the support structure 14 has a width extending along a base of the handle 15, with an apex of the handle 15 disposed opposite the support structure 14. Further, in the shown embodiment, the base 11 further comprises a weighted element therein, such that the user can lean on the handle 15 and rely on the support provided by the weighted base 11 without concern the ambulatory cane umbrella 10 will fall over.

In the shown embodiment, a basket 17 is disposed along the handle 15, wherein the basket 17 encompasses the space between the handle 15 and the support structure 14 such that the basket 17 is parallel to the support structure 14. In some embodiments, the basket 17 is removably securable to the handle 15 via a plurality of hooks 20 disposed about the handle 15. The basket 17 includes an aperture at the handle 15, wherein the aperture is in communication with an interior volume of the basket 17, thereby allowing the user to store a plurality of items therein. In the shown embodiment, the basket 17 is composed of a mesh material such that the user can easily determine what items are stored therein. In the illustrated embodiment, the basket 17 is dimensioned such that the basket 17 has a length equivalent to the height of the support structure 14, thereby allowing the user to store a plurality of items therein. However, in other embodiments, the basket 17 has a length less than the height of the support structure 14, such that the user can easily reach within the basket 17 to draw out the desired item.

A support brace 16 is disposed along the handle 15 at a distal end opposite the basket 17. The support brace 16 is configured to receive a handle of an umbrella 70 therein. In the illustrated embodiment, the support brace 16 is dimensioned such that the handle of the umbrella 70 can be rotated therein, thereby allowing the user to manipulate the umbrella 70 into an upright position wherein the handle is supported in the support brace 16. As illustrated, the base 11 is appropriately dimensioned to ensure the distalmost point of the umbrella 70 is supported atop the base 11 when the umbrella 70 is in the support brace 16 while in the closed position. In alternate embodiments, the base 11 further comprises a recess or opening therethrough, configured to receive the distalmost point of the umbrella 70 therein. In the illustrated embodiment, the plurality of hooks 20 are disposed along a perimeter of the handle 15. In some embodiments, additional hooks 20 are disposed within the basket 17, thereby allowing the user to store a plurality of items thereon.

Figure 2:
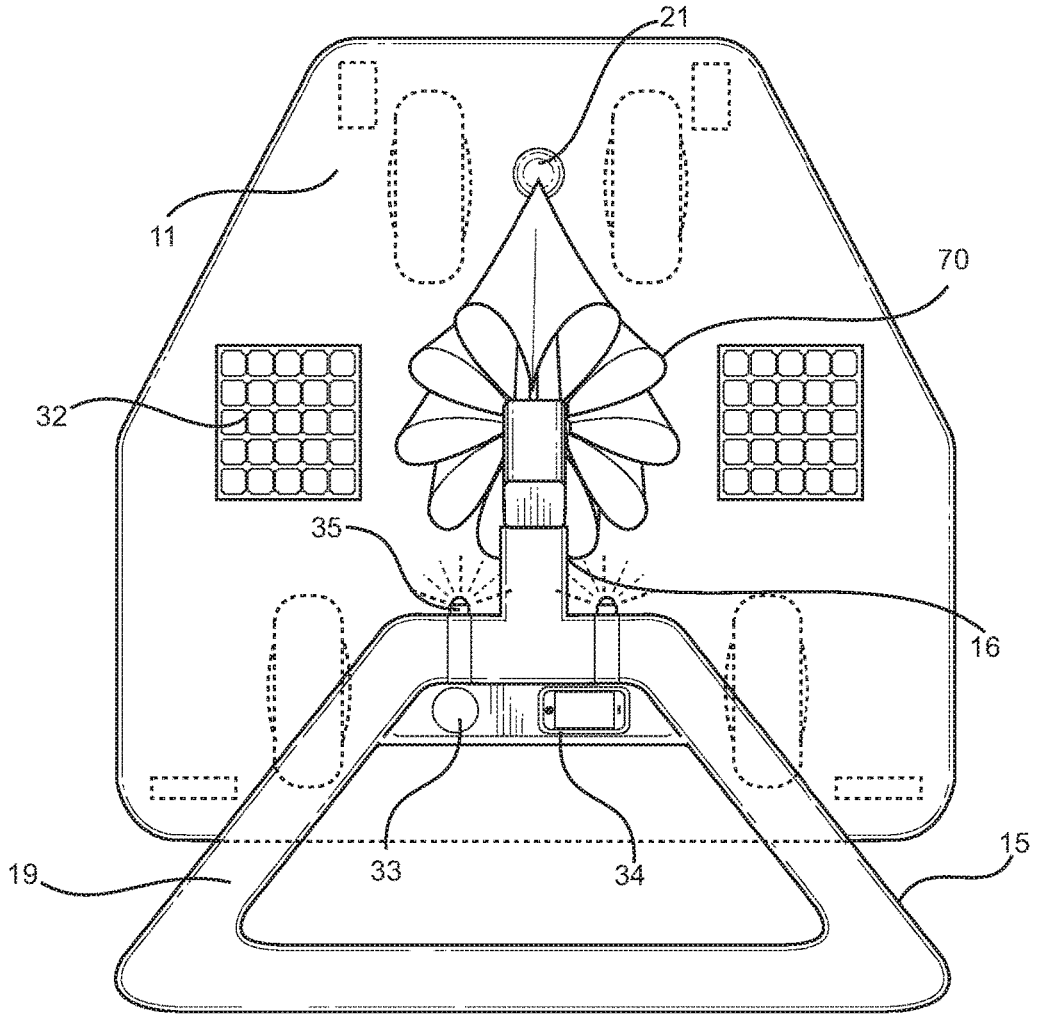
FIG. 2 shows a top plan view of an embodiment of the ambulatory cane umbrella.

Referring now to FIG. 2, there is shown a top plan view of an embodiment of the ambulatory can umbrella. In the illustrated embodiment, the handle 15 comprises a trapezoidal shape having an aperture 19 through a center thereof, wherein the aperture 19 provides access to the interior volume of the basket. In this way, the user can easily place objects within the basket while still utilizing the handle 15. The handle 15 is affixed to the support structure opposite the support brace 16, wherein an end of the handle 15 opposite the support brace 16 is perpendicular thereto. In the illustrated embodiment, the aperture 19 further includes a receptacle 33 disposed therein, wherein the receptacle is configured to secure a beverage container therein. In another embodiment, the handle 15 further comprises a docking station 34 disposed within the aperture 19, wherein the docking station 34 is configured to receive a mobile device therein. In some embodiments, the docking station 34 is operably connected to the power source, such that a user can charge the mobile device attached to the docking station 34. Furthermore, in the illustrated embodiment, the handle 15 further comprises at least one light 35 disposed along a front side thereof, wherein the light 35 is operably connected to the power source, such as via a wire extending along the length of the support structure. The light 35 is configured to illuminate the area ahead of the user, such that the user is provided greater visibility in low-light conditions. In some embodiments, a pair of lights 35 are disposed on the handle 15 on opposing sides of the support structure to provide a wider range of vision.

In the shown embodiment, the base 11 further comprises a recess 21 therein, wherein the recess is configured to receive a distalmost tip of the umbrella 70. In this way, variances in attachment of the umbrella 70 can be accounted for, allowing umbrellas 70 having differing lengths to easily support rotate about the support brace 16. Additionally, the recess 21 can be configured to frictionally engage the umbrella 70 therein, such that the umbrella 70 is securely stored when not in use. Furthermore, in the illustrated embodiment, the supports 12 are disposed at each corner of the base 11 to provide maximum support, while simultaneously occupying minimal space, thereby allowing the user to access a greater area of the base 11 for storage or the like. Additionally, in the illustrated embodiment, the base 11 further comprises at least one solar panel 32 on an upper surface thereof, wherein the solar panel 32 is operably connected to the battery, such that the user can extend the life of the battery via solar power.

Figure 3:
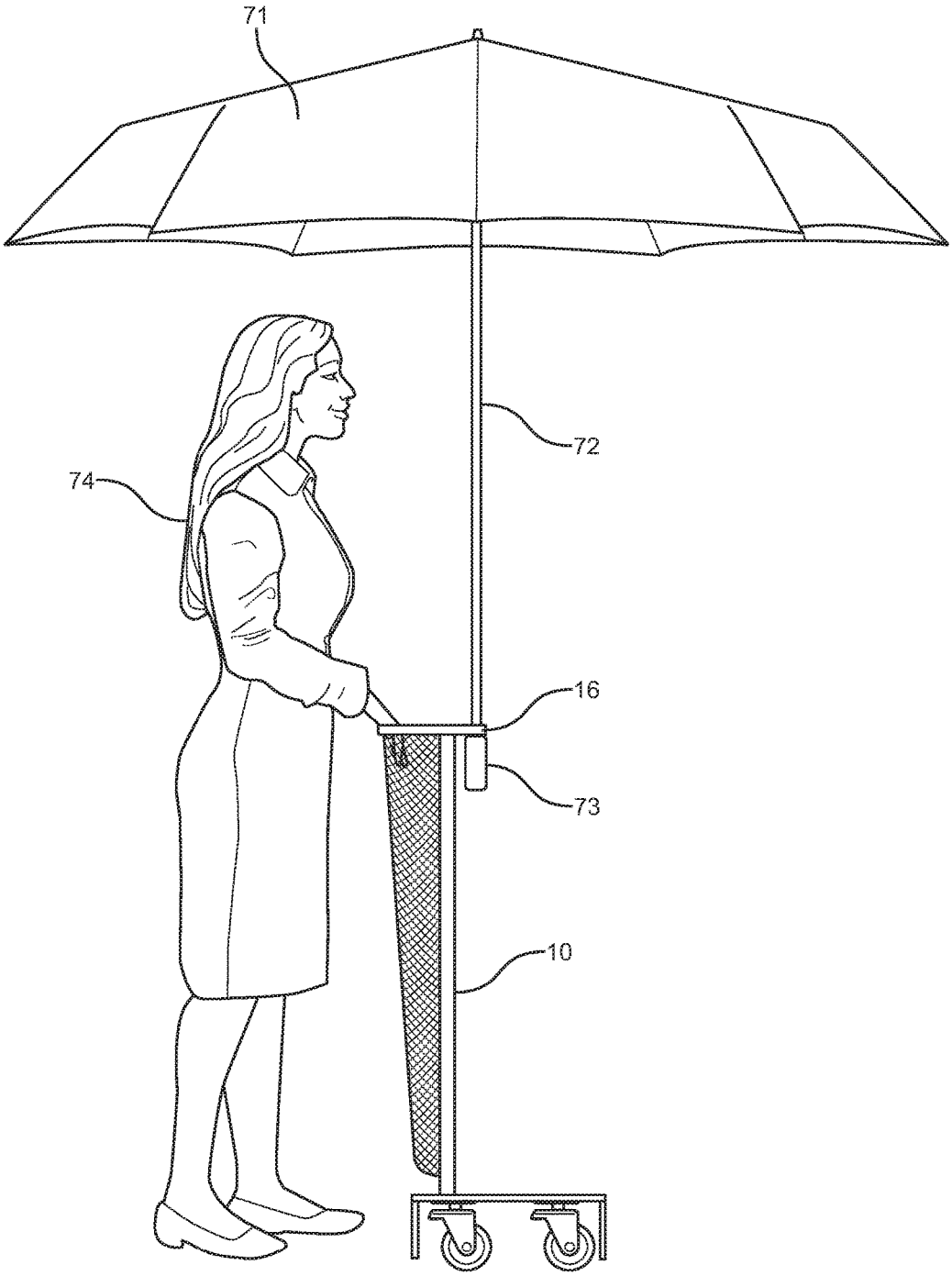
FIG. 3 shows a side view of an embodiment of the ambulatory cane umbrella in use.

Referring now to FIG. 3, there is shown a side view of an embodiment of the ambulatory cane umbrella in use. In operation, a user 74 will utilize the ambulatory cane umbrella 10 for support. When the user desires to utilize the umbrella, the user will rotate the umbrella within the support brace 16, such that the umbrella handle 73 is positioned beneath the handle of the ambulatory cane umbrella 10 and aligned parallel to the basket. Thus, the umbrella stand 72 will extend outwardly from the support brace 16 and the base of the ambulatory cane umbrella 10 such that the umbrella canopy 71 is disposed overhead the user 74. In this way, a user can rely on an ambulatory support device with storage for assistance wherein the device can additionally support a pivotable umbrella.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An ambulatory cane umbrella, comprising:

a base having an upper surface and a lower surface;

a plurality of supports disposed around a perimeter of the base extending from the lower surface, wherein the plurality of supports are slidably disposed through the base, such that the plurality of supports are configured to selectively move between a deployed position and a retracted position, wherein the deployed position, the plurality of supports are perpendicular to the base along the lower surface thereof one or more wheels disposed on the lower surface;

a support structure extending from the upper surface perpendicular to the base;

a handle disposed atop the support structure;

a basket disposed along the support structure having an aperture at the handle in communication with an interior of the basket;

a support brace disposed at a distal end of the handle opposite the basket;

wherein the support brace is configured to hold an umbrella therein.

2. The ambulatory cane umbrella of claim 1, wherein a plurality of hooks are disposed along a perimeter of the handle.

3. The ambulatory cane umbrella of claim 1, wherein the upper surface of the base is planar.

4. The ambulatory cane umbrella of claim 1, wherein the support brace allows the umbrella to pivot 180-degrees.

5. The ambulatory cane umbrella of claim 1, wherein the base further comprises a weighted element therein configured to provide stability to the ambulatory cane.

6. The ambulatory cane umbrella of claim 1, wherein the handle extends orthogonally from the support structure such that the handle is oriented parallel to the base.

7. The ambulatory cane umbrella of claim 1, wherein the plurality of wheels comprise casters such that the plurality of wheels are rotatable about a longitudinal axis thereof.

8. The ambulatory cane umbrella of claim 1, wherein a height of the support structure is telescopically adjustable.

9. The ambulatory cane umbrella of claim 1, further comprising a power source disposed on the lower surface.

10. The ambulatory cane umbrella of claim 9, further comprising a motor disposed on the lower surface operably connected to the wheels and the power source.

11. The ambulatory cane umbrella of claim 9, wherein the power source comprises a battery disposed on the lower surface.

12. The ambulatory cane umbrella of claim 11, wherein the battery is operably connected to a solar panel disposed on the upper surface.

13. The ambulatory cane umbrella of claim 9, wherein the power source is operably connected to at least one light disposed on the handle.

14. The ambulatory cane umbrella of claim 9, further comprising a docking station disposed within the handle, wherein the docking station is configured to receive a mobile device therein.

15. The ambulatory cane umbrella of claim 14, wherein the docking station is operably connected to the power source.

16. The ambulatory cane umbrella of claim 1, further comprising a receptacle within the handle, the receptacle configured to receive a beverage container therein.

17. An ambulatory cane umbrella, comprising:

a base having an upper surface and a lower surface;

a plurality of supports disposed around a perimeter of the base extending from the lower surface;

one or more wheels disposed on the lower surface;

a support structure extending from the upper surface perpendicular to the base;

a handle disposed atop the support structure;

a basket disposed along the support structure having an aperture at the handle in communication with an interior of the basket;

a support brace disposed at a distal end of the handle opposite the basket;

wherein the support brace is configured to hold an umbrella therein;

wherein the handle comprises a planar top having a trapezoidal shape, wherein an end of the handle opposite the support brace is perpendicular thereto.

18. The ambulatory cane umbrella of claim 17, wherein a plurality of hooks are disposed along a perimeter of the handle.

19. The ambulatory cane umbrella of claim 17, wherein the upper surface of the base is planar.

20. The ambulatory cane umbrella of claim 17, wherein the support brace allows the umbrella to pivot 180-degrees.

21. The ambulatory cane umbrella of claim 17, wherein the base further comprises a weighted element therein configured to provide stability to the ambulatory cane.

22. The ambulatory cane umbrella of claim 17, wherein the handle extends orthogonally from the support structure such that the handle is oriented parallel to the base.

23. The ambulatory cane umbrella of claim 17, wherein the plurality of wheels comprise casters such that the plurality of wheels are rotatable about a longitudinal axis thereof.

24. The ambulatory cane umbrella of claim 17, wherein a height of the support structure is telescopically adjustable.

25. The ambulatory cane umbrella of claim 17, further comprising a power source disposed on the lower surface.

26. The ambulatory cane umbrella of claim 25, further comprising a motor disposed on the lower surface operably connected to the wheels and the power source.

27. The ambulatory cane umbrella of claim 25, wherein the power source comprises a battery disposed on the lower surface.

28. The ambulatory cane umbrella of claim 27, wherein the battery is operably connected to a solar panel disposed on the upper surface.

29. The ambulatory cane umbrella of claim 25, wherein the power source is operably connected to at least one light disposed on the handle.

30. The ambulatory cane umbrella of claim 25, further comprising a docking station disposed within the handle, wherein the docking station is configured to receive a mobile device therein.

31. The ambulatory cane umbrella of claim 30, wherein the docking station is operably connected to the power source.

32. The ambulatory cane umbrella of claim 17, further comprising a receptacle within the handle, the receptacle configured to receive a beverage container therein.

33. An ambulatory cane umbrella, comprising:

a base having an upper surface and a lower surface;

a plurality of supports disposed around a perimeter of the base extending from the lower surface, wherein the plurality of supports are slidably disposed through the base, such that the plurality of supports are configured to selectively move between a deployed position and a retracted position;

one or more wheels disposed on the lower surface;

a support structure extending from the upper surface perpendicular to the base;

a handle disposed atop the support structure;

a basket disposed along the support structure having an aperture at the handle in communication with an interior of the basket;

a support brace disposed at a distal end of the handle opposite the basket;

wherein the support brace is configured to hold an umbrella therein.

34. An ambulatory cane umbrella, comprising:

a base having an upper surface and a lower surface;

a plurality of supports disposed around a perimeter of the base extending from the lower surface;

one or more wheels disposed on the lower surface;

a support structure extending from the upper surface perpendicular to the base;

a handle disposed atop the support structure;

a basket disposed along the support structure having an aperture at the handle in communication with an interior of the basket;

a support brace disposed at a distal end of the handle opposite the basket;

wherein the support brace is configured to hold an umbrella therein;

wherein the handle comprises a planar top having a trapezoidal shape.

* * * * *